United States Patent [19]

McCullough

[11] 4,355,812

[45] Oct. 26, 1982

[54] STACK OF CARDS REPRESENTING DICE AND BACKGAMMON GAME

[76] Inventor: Robert W. McCullough, 125 Burnett Dr., Spartanburg, S.C. 29303

[21] Appl. No.: 199,020

[22] Filed: Oct. 20, 1980

[51] Int. Cl.[3] ..... A63F 3/00; A63F 9/00

[52] U.S. Cl. ..... 273/248; 273/296

[58] Field of Search ..... 273/243, 248, 249, 293, 273/296; D21/42–46

[56] References Cited

U.S. PATENT DOCUMENTS

| | | | |
|---|---|---|---|
| D. 59,761 | 11/1921 | McCarthy | D21/43 |
| D. 230,617 | 3/1974 | Ekstrand . | |
| 741,984 | 10/1903 | Tavenner . | |
| 1,099,563 | 6/1914 | Meyers | 273/243 |
| 1,129,423 | 2/1915 | Parker . | |
| 1,236,094 | 8/1917 | Lloyd . | |
| 2,232,055 | 2/1941 | Davis | 273/243 |
| 2,722,425 | 11/1955 | Gazelle . | |
| 3,663,021 | 5/1972 | Whippo | 273/296 |

FOREIGN PATENT DOCUMENTS

| | | | |
|---|---|---|---|
| 349357 | 12/1905 | France | 273/248 |
| 593999 | 10/1947 | United Kingdom | 273/293 |

*Primary Examiner*—Richard C. Pinkham
*Assistant Examiner*—Scott L. Brown
*Attorney, Agent, or Firm*—Stevens, Davis, Miller & Mosher

[57] ABSTRACT

A game using a deck of cards to generate and preserve a random sequence of number pairs which simulate roll of two die. On the front and back of each card, a number is represented. The numbers represented on the front and back of each card are independent of each other. Each number is represented on the cards in the deck the same number of times as is any other number represented on the cards in the deck. The number of cards in the deck is a whole multiple of the largest number represented by any of the cards in the deck. In duplicate backgammon and other games which normally involve dice, the largest number is 6.

7 Claims, 8 Drawing Figures

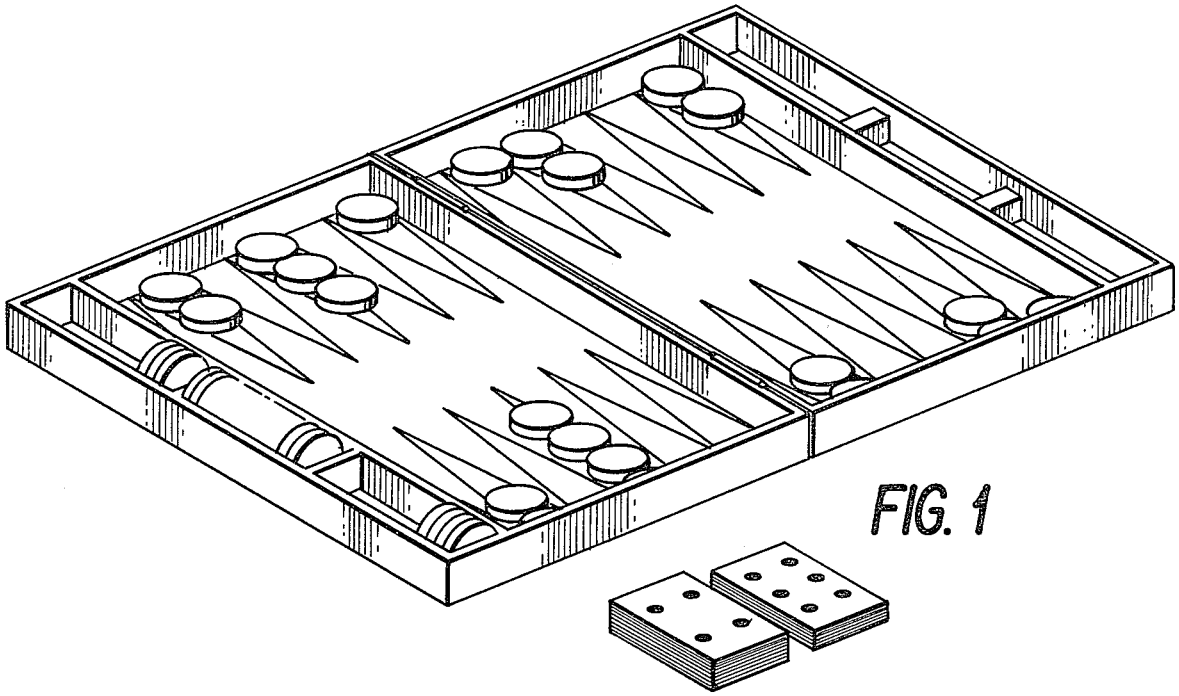
FIG. 1
FIG. 2
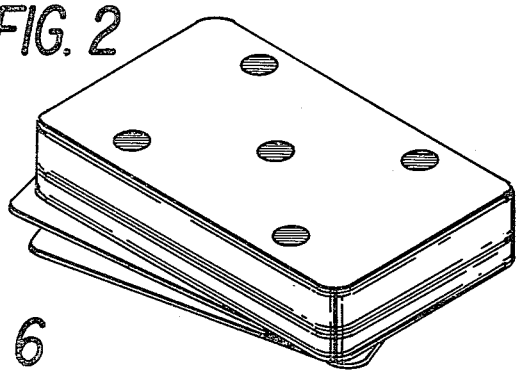
FIG. 3
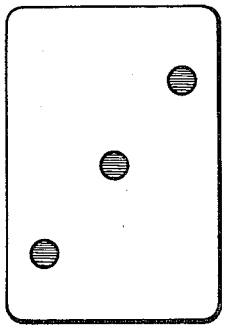
FIG. 4
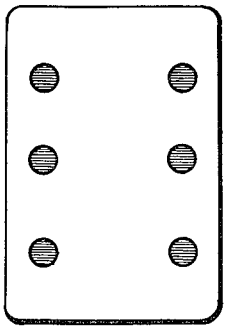
FIG. 6
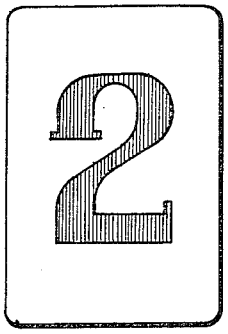
FIG. 7
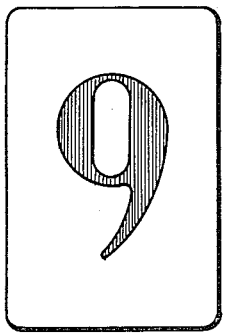
FIG. 5
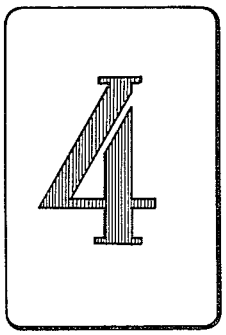
FIG. 8
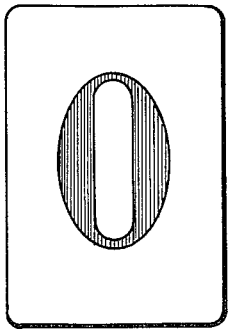

STACK OF CARDS REPRESENTING DICE AND BACKGAMMON GAME

SUMMARY OF THE INVENTION

The present invention relates to the games involving the use of chance means, such as dice in the game of backgammon for example, using as a chance means a set of objects of identical dimensions having only two numbers represented on each object, one number on one side and one number on the opposite side. The present invention provides a means to repeat games, duplicating in all of them the same move opportunities, thus allowing two or more players to compete under virtually identical conditions of play.

In a conventional game of backgammon, playing dice are used to furnish a pair of numbers randomly selected from the series of digits 1 through 6 at the beginning of each player's turn. By the end of the game, each player has gone through a series of dice throws and, unless the series of random numbers generated by the first and every subsequent throw of each die is recorded, the series of numbers generated by each die during the game is lost. Once the series of numbers is lost, it is not possible to play subsequent games of backgammon using the same series of die throw numbers as in the first game.

With the present invention, the random series of numbers equivalent to die throws is generated and retained for future use by a set of stackable, identically dimensioned, objects. With these means it is easily possible to play a series of backgammon games duplicating in each the same series of random numbers used in the first games since the sequence of numbers is preserved in the sequence of the stacked objects.

The advantage of this duplicate backgammon over present backgammon is that a set of stackable rearrangable objects, instead of a pair of dice is used as the chance means, and thus a duplicate backgammon game can be played using the same stack of objects, i.e., without shuffling them or rearranging their sequence. The element of luck for each player in duplicate backgammon is removed, and the same game can be played over again to determine which player has more backgammon skill, each being given the same series of numbers inherent in the arrangement of objects.

Backgammon is the game used to illustrate the present invention, but other games which conventionally use dice, such as "craps" also are applicable.

The preferred configuration of the set of restackable objects is a deck of cards similar in shape to conventional playing cards, but numbered on both sides and used, in a novel way.

The present invention may be more fully understood from the description of preferred embodiments of the invention set forth below, together with the accompanying drawings.

BRIEF DESCRIPTION OF THE DRAWINGS

FIG. 1 is a perspective view of a backgammon playing board with markers and a deck of cards;

FIG. 2 is a perspective view of the deck of cards;

FIG. 3 is a top view of a card and its marking;

FIG. 4 is a bottom view of the card shown in FIG. 3;

FIG. 5 is a top view of an alternative card and its marking;

FIG. 6 is a bottom view of the card shown in FIG. 5;

FIG. 7 is a top view of an alternative card and its marking; and

FIG. 8 is a bottom view of the card shown in FIG. 7.

DESCRIPTION OF THE PREFERRED EMBODIMENTS

The present invention provides an alternative means to the use of dice in games. These means will eliminate the inequities arising from the use of dice as normally furnished and used in the play of games.

Dice sold to the public for use with games such as "Backgammon", "Monopoly", "craps", and many others, are believed by most players to be "true". It is commonly accepted that the dice will, in normal play and over many plays, furnish all of the numbers 1 through 6 in equal frequencies.

I have found through experimentation and study that dice furnished with games purchased by the public are not "true", and their use introduces bias into the play which is unsuspected and unnoticed, but is important to the outcome of the game.

Players of a novice class do not usually pay much attention to mathematical probabilities and other statistical criteria when they use dice. Expert players however, use probabilities and other statistical aids to enhance the excellence of their play decision. A basic assumption made by expert players is that the dice are "true" and thus, they will follow the mathematical principles of probability. Dice that are not "true" do not perform according to the usual laws of probability and, an expert player will make decisions of play which are less than optimum when he unknowingly uses "untrue" dice.

To illustrate the foregoing, the following table contains typical values of non-uniformity exhibited by dice furnished with a conventional board and pieces for a game of "Backgammon".

The four examples following were selected from others I have studied and show the mathematical bias present in each of these four dice. If each die were "true", each of the relative frequency ratios would be 1.00. Note that all four of the dice in this example show statistical bias and to a significant degree.

RELATIVE FREQUENCY RATIOS FROM EXPERIMENTS

| | NUMBER ON THE DIE FACE | | | | | | No. of | |
|---|---|---|---|---|---|---|---|---|
| DIE NUMBER | 1 | 2 | 3 | 4 | 5 | 6 | Throws | P |
| 1 | .75 | 1.00 | .69 | .84 | .96 | .78 | 502 | 1:12 |
| 2 | .60 | .91 | 1.00 | .86 | .83 | .75 | 501 | 1:25 |
| 3 | .65 | .83 | .83 | 1.00 | .86 | .71 | 496 | 1:15 |
| 4 | .76 | 1.00 | .87 | .80 | .85 | .68 | 502 | 1:3 |

The numbers in the table indicate the observed relative frequency of each of the numbered faces on top of the die as they appeared during the course of each test. Each experimental test series consisted of approximately 500 tosses and observations of each die. The data have been normalized so that the most frequently observed number in each of the four dice tested was given a ratio of 1.00 and, the other five numbers fairly proportioned. These data have been analyzed by conventional modern statistical procedures and Column P shows the odds that these sets of frequency ratios could have occurred as a matter of chance.

For a die to be true, several parameters, all very difficult to achieve, must be satisfied.

1. All sides of the cube must be exactly equal in length.
2. The mass density of the material from which the die is made must be the same at all points throughout the die.
3. All internal angles must be exactly 90 degrees in all three directions at every corner.
4. All eight corners of the cube must have the same roundness. It is impossible from practical considerations to produce a true 90 degree corner on a cube. The question is not whether the corners are truly square, but how untrue they are and, how consistently they deviate from a true corner.
5. The placing of the numbers one through six on the faces of the die, by painting, engraving, stencilling, printing, etc., must not shift the mass center of gravity of the die from its geometric center.
6. All six sides of the die must display the same frictional, sliding characteristics. The coefficient of friction of all six sides must be the same when tested on the surface on which the die are tossed.

In professional gambling locations, casinos and the like, great care is taken to obtain dice which meet as closely as possible the above criteria. Even under the best conditions it is recognized by professionals that the best available dice may not be "true". Thus, it is common in most reputable casinos to replace a set of dice without question, with a new set when any player in the game asks that it be done.

Dice manufactured to very close tolerances and specifications are quite expensive. It is not economically feasible to provide them to the average consumer who purchases a game as "Backgammon", "Monopoly", etc., for his private amateur enjoyment.

The present invention provides a means superior to dice which will furnish in mathematically correct proportions, a series of numbers in random order, with equal probability of occurence for each number and, with no discernable or predictable sequence.

An equally important feature of the present invention is that the sequence of numbers revealed during the play of a game is retained in the stacked sequence of objects and is available for reuse when a repeat game, using a duplicate series of play opportunities, is desired.

The configuration of the identical shaped objects in the set is not limited to card shaped objects. For example, they could be cubes or any other rectangular parallelepiped. Blocks configured like conventional dominoes could be used. Square ended rods shaped like conventional checkers could be used. But, whatever the shape, the objects must be readily stackable and from practical considerations, have two opposing flat sides.

The preferred configuration is that of a parallelepiped, two of whose dimensions are approximately equal and ratioed no larger than 3 to 1. The third dimension is preferred to be much smaller than either of the first two and ratioed at last 100 to 1 to the larger of the first two dimensions. The shape of a conventional playing card represents the preferred configuration and is deemed to be the best of all the possible shapes conceived.

In the present invention, a deck of novel and uniquely marked cards is used as the source of chance means in backgammon. The chance means conventionally is a set of dice for each player, but in this invention a deck of cards is substituted for the dice normally used. Each face of each of the cards in the deck represents one face of a die. On each of the two faces of each card is imprinted a quantity of dots, a number, or any other symbol to indicate a number. The dots or symbols indicate a single number in the consecutive group, one through six.

Preferably, these dots are arranged in the same manner as they are on conventional dice. See, for example, FIGS. 3 and 4 which show three dots on one side and six dots on the reverse side, respectively. Alternatively, as shown in FIGS. 5 and 6, one face of the card could bear any one of the numbers 1, 2, 3, 4, 5 or 6 and the opposite face could also bear any one of those numbers. Numbers other than 1 through 6 can be used, depending upon the particular game being played.

Each card has one set of dots or a number printed on its face and another printed on its back. The individual sets of dots or the number on the backs are randomly selected, and may be the same as or different from, the set of dots or the number on the respective card fronts. Throughout the entire deck, all of the sets of dots or other symbols on the cards represent one of the numbers in the series 1, 2, 3, 4, 5 or 6.

In order that there be an equal probability of each number turning up as cards are successively turned over from the deck, it is essential that the number of times each number is represented throughout the deck is the same as the number of times any of the other numbers are represented throughout the deck. For example, there should be as many card sides with three dots or the number 3 on them as there are card sides with six dots or the number 6 on them or, any other of the numbers in the series.

To insure that there will be equal probability for all numbers to occur in each play, the deck of cards comprises a number of cards equal to a whole multiple of the largest number represented on the cards. In backgammon, where the cards are used to simulate dice, six is the largest number represented and thus, the deck of cards shall contain a number of cards equal to a whole multiple of six, e.g., six, twelve, eighteen, twenty-four, thirty, thirty-six, etc. cards. In another application, the generation of random numbers where all 10 digits are used, the deck should contain 10, 20, 30 . . . 100 cards or any whole multiple of the number ten.

To start a game of duplicate backgammon, the cards are shuffled to establish a random sequence of cards and thus, a random sequence of the sets of dots or numbers on them. The deck of cards is then placed next to the backgammon board. The playing pieces are placed on the board the same way as in conventional backgammon. To begin play, the top card is turned over and placed top down next to the deck of cards. This exposes two new numbers, represented by the set of dots or the numbers, one on the bottom of the turned over card and, the other on the top of the second card in the deck. These two numbers are used by the first player for his first turn as he would use the two numbers generated by a dice throw in conventional backgammon. The first player then decides and makes his moves of playing pieces as he would in backgammon.

The second player to begin his turn, turns over the second card from the deck places it top down on the first card. Again, the turned over second card and the top of the third card now on top of the deck, expose two new numbers which the second player uses for his turn and, the second player then moves his playing pieces. Play continues by turning over the topmost card on the deck for each turn. As the cards are turned over they are placed on top of each other to preserve the exact sequence of cards in the deck. In order to complete a large majority of games of backgammon without exhausting the deck, a deck of seventy-two cards is typically needed. If all cards in the deck are used before an unusually long backgammon game is complete, the exhausted deck is simply restored to its original position and play continues.

By preserving the sequence of cards during and after each game, any number of successive games can be played using the same sequence of individual plays. The element of luck in the game can be virtually eliminated by use of a two game set wherein the players reverse starting positions in the second game. In the two game set, each player will have worked under the same sequence of simulated die throws (with the cards in the same order) as did the other player. Also, identical games of duplicate backgammon can be played by other players so as to see how different players react and play to the same sequence of numbers, in their judgement and movement of the playing pieces.

By having a group of players play each other in duplicate backgammon with the same sequence of numbers for movement of the playing pieces, the skill of each of the players relative to all other players in the group can be determined virtually unaffected by the chance element inherent in the use of die.

The cards can be used in any other game or situation besides duplicate backgammon in which a series of random numbers is needed. The obvious advantages of the availability of repeatable random numbers sequences which has just been shown for duplicate backgammon will also follow for other games.

The above discussion has disclosed the best mode of the present invention but in no way limits the present invention to cards representing numbers by means other than dots or to games and situations other than duplicated backgammon.

What is claimed is:

1. A stack of cards containing a multiple of three cards for simulating the statistically random sequential occurrences of any and all possible combinations resulting from the roll of two dice, each card of said stack having two opposing faces, a first symbol on one face, a second symbol on the other face, said first symbol representing only one number chosen from the group consisting of the numbers 1 through 6, said second symbol representing only one number chosen from the group consisting of the numbers 1 through 6, each said number occurring the same number of times throughout said stack, said first and second symbols chosen so that the values represented by said first and second symbols have a random relationship, said random sequential occurrences being generated by the sequential pairing of two of said symbols, said random relationship of first and second symbols and said equal number of occurrences of each number in said stack insuring that there is a statistical probability greater than 0 associated with the event of any pair of numbers occurring more than two times during the simulation of said statistically random sequential occurrences.

2. A stack of cards containing a multiple of three cards for simulating the statistically random sequential occurrences of any and all possible combinations resulting from the roll of two dice, each card of said stack having two opposing faces, a first symbol on one face, a second symbol on the other face, said first symbol representing only one number chosen from the group consisting of the numbers 1 through 6, said second symbol representing only one number chosen from the group consisting of the numbers 1 through 6, each said number occurring the same number of times throughout said stack, said first and second symbols chosen so that values represented by first and second symbols have a random relationship, said random sequential occurrences being generated by the combination of the symbol on one of the faces of a first card with the symbol on one of the faces of a second card adjacent thereto, said random relationship of said first and second symbols and said equal number of occurrences of each number in said stack insuring that there is a known statistical probability greater than 0 associated with the event of any pair of numbers occurring more than two times during the simulation of said statistically random sequential occurrences.

3. A deck of playing cards as claimed in claim 1 or 2, wherein the symbols are sets of dots chosen from the group consisting of 1, 2, 3, 4, 5 and 6 dots.

4. A deck of playing cards as claimed in claim 1 or 2, wherein the symbols are Arabic numerals chosen from the group consisting of the integers 1 through 6.

5. A duplicate backgammon game comprising:

a playing board, movable playing pieces, and a chance means comprising a stack of cards containing a multiple of three cards for simulating the statistically random sequential occurrences of any and all possible combinations resulting from the roll of two dice, each card of said stack having two opposing faces, a first symbol on one face, a second symbol on the other face, said first symbol representing only one number chosen from the group consisting of the numbers 1 through 6, said second symbol representing only one number chosen from the group consisting of the numbers 1 through 6, each said number occurring the same number of times throughout said stack, said first and second symbols chosen so that the values represented by said first and second symbols have a random relationship, said random sequential occurrences being generated by sequential pairings of two of said symbols, said random relationship of first and second symbols and said equal number of occurrences of each number in said stack insuring that there is a statistical probability larger than zero associated with the event of any pair of numbers occurring more than two times during the simulation of said statistically random sequential occurrences.

6. A duplicate backgammon game comprising:

a playing board, movable playing pieces, and a chance means comprising a stack of cards containing a multiple of three cards for simulating the statistically random sequential occurrences of any and all possible combinations resulting from the roll of two dice, each card of said stack having two opposing faces, a first symbol on one face, a second symbol on the other face, said first symbol representing only one number chosen from the group consisting of the numbers 1 through 6, said second symbol representing only one number chosen from the group consisting of the numbers 1 through 6, each said number occurring the same number of times through the deck, said random sequential occurrences being generated by the combination of the symbol on one of the faces of a first card with the symbol on one of the faces of a second card adjacent thereto, said random relationship of said first and second symbols and said equal number of occurrences of each number in said deck insuring that there is a statistical probability larger than zero associated with the event of any pair of numbers occurring more than two times during the simulation of said statistically random sequential occurrences.

7. A duplicate backgammon game as claimed in claim 5 or 6, wherein each stack of cards have the capability to store a sequence of number pair representations.

* * * * *